US005950058A

United States Patent [19]

Kusaba et al.

[11] Patent Number: 5,950,058

[45] Date of Patent: Sep. 7, 1999

[54] IMAGE FORMING APPARATUS

[75] Inventors: Takashi Kusaba; Akihiko Nakazawa, both of Shizuoka-ken; Toshio Takamori, Numazu, all of Japan

[73] Assignee: Canon Kabushiki Kaisha, Tokyo, Japan

[21] Appl. No.: 09/026,947

[22] Filed: Feb. 20, 1998

[30] Foreign Application Priority Data

Feb. 21, 1997 [JP] Japan ..... 9-038162
Feb. 12, 1998 [JP] Japan ..... 10-029747

[51] Int. Cl.[6] ..... G03G 15/14; G03G 21/00

[52] U.S. Cl. ..... 399/302; 399/308

[58] Field of Search ..... 399/297, 298, 399/302, 308

[56] References Cited

U.S. PATENT DOCUMENTS

| | | | |
|---|---|---|---|
| 5,519,475 | 5/1996 | Miyamoto et al. . | |
| 5,530,532 | 6/1996 | Iino et al. . | |
| 5,565,975 | 10/1996 | Kumon et al. . | |
| 5,745,830 | 4/1998 | Fujiwara et al. | 399/308 |
| 5,761,594 | 6/1998 | Seto et al. | 399/302 |
| 5,805,967 | 9/1998 | De Bock et al. | 399/299 |

FOREIGN PATENT DOCUMENTS

| | | |
|---|---|---|
| 0 738 938 | 10/1996 | European Pat. Off. . |
| 56-153357 | 11/1981 | Japan . |
| 59-50475 | 3/1984 | Japan . |
| 63-194272 | 8/1988 | Japan . |
| 1-105980 | 4/1989 | Japan . |
| 4-303869 | 10/1992 | Japan . |
| 4-340564 | 11/1992 | Japan . |
| 5-297739 | 11/1993 | Japan . |
| 5-303310 | 11/1993 | Japan . |
| 6-202494 | 7/1994 | Japan . |
| 8-160763 | 6/1996 | Japan . |
| 10-48962 | 2/1998 | Japan . |

OTHER PUBLICATIONS

*Patent Abstracts of Japan,* Image Forming Device for Japanese Published Application 08–160763, Jun. 21, 1996.

*Primary Examiner*—Richard Moses
*Attorney, Agent, or Firm*—Fitpatrick, Cella, Harper & Scinto

[57] ABSTRACT

This invention relates to an image forming apparatus comprises an image bearing member for bearing a toner image, an intermediate transfer member for allowing the toner image on the image bearing member to undergo electrostatic primary transfer thereto at the position of primary transfer and then enabling the toner image deposited thereon to undergo secondary transfer to a transfer material, and a charging member for charging a residual toner remaining on the intermediate transfer member after the second transfer of the toner image on the intermediate transfer member to a transfer material and consequently causing the residual toner charged by the charging member to be transferred at the position of primary transfer to the image bearing member. Wherein the sum of the surface roughness, Rz, of the intermediate transfer member and that of the charging member is not less than 1 μm and not more than 50 μm.

9 Claims, 6 Drawing Sheets

IMAGE FORMING APPARATUS

BACKGROUND OF THE INVENTION

1. Field of the Invention

This invention relates to an image forming apparatus utilizing an electrophotographic process and more particularly to such an image forming apparatus as a copying machine, a laser beam printer, or a system of facsimile which forms an image by effecting primary transfer of a toner image formed on an image bearing member provisionally onto an intermediate transfer member and secondary transfer of the toner image so received on the intermediate transfer member onto a transfer material by means of a contact transfer member.

2. Related Background Art

The image forming apparatus which attains the formation of an image by effecting primary transfer of a toner image formed on a drum-shaped electrophotographic photosensitive member as an image bearing member (hereinafter referred to as a "photosensitive member") provisionally onto an intermediate transfer member and secondary transfer of the toner image so received on the intermediate transfer member onto a transfer material by means of a contact transfer member serves effectively as a color image forming apparatus or a multicolor image forming apparatus which produces an image by subjecting the plurality of component color images of a color image information or a multicolor image information to sequential superposing transfer. Thus, a color image or a multicolor image or as an image forming apparatus which is endowed with the ability to form a color image or the ability to form a multicolor image is synthetically reproduced. It can obtain an image which does not incur any misregister of the component color images (misregister of colors).

In the image forming apparatus constructed as described above, it is important for the purpose of obtaining a perfect image to ensure removal of the toner which remains on the intermediate transfer member after the secondary transfer of the toner image from the intermediate transfer member to such a transfer material as sheet. For the conventional image forming apparatus of this class, the following methods (a)–(d), for example, have been proposed for the removal of the toner which remains on the intermediate transfer member.

(a) A method which comprises causing an elastic blade to make and break contact with the intermediate transfer member thereby scraping the residual toner on the intermediate transfer member (as disclosed in JPA 56-153357 and JPA 5-303310, for example).

(b) A method which comprises providing the intermediate transfer member with a far brush adapted to make and break contact therewith, applying to the residual toner on the intermediate transfer member a bias of the reversed polarity relative to the residual toner and consequently recovering the residual toner, causing the recovered toner provisionally to adhere to a bias roller such as a metallic roller, and scraping the toner from the bias roller with a blade.

(c) A method which comprises causing the residual toner on the intermediate transfer member to return to a photosensitive member by means of an electric field with a view to allaying the burden of the blade cleaner mentioned above (as disclosed in JPA 4-340564 and JPA 5-297739, for example).

(d) A method which comprises providing an charging device adapted to charge the residual toner on the intermediate transfer member to a reversed polarity relative to the charged potential of the photosensitive member, and causing the residual toner on the intermediate transfer member to return to the photosensitive member solely by the operation of the charging device for precluding the wastefulness of providing similar cleaning devices severally for the intermediate transfer member and the photosensitive member and simplifying the construction of the cleaning device (as disclosed in JPA 1-105980, for example).

Incidentally, the methods of (a) and (b) mentioned above which clean the intermediate transfer member of the residual toner solely by the mechanical force of the elastic blade or the brush have the problem of incomplete cleaning due to readily leakage of the residual toner through the blade or the brush. They also have the problem of further incurring incomplete cleaning due to gradual wear of the cleaning member resulting from a repeated cleaning operation.

The cleaning method of (c) mentioned above which utilizes in combination a mechanical force and an electrostatic force is effective in respect that it differs from such mechanical means as mentioned above. This method nevertheless has the problem of necessitating a cleaning step for removing the residual toner on the intermediate transfer member separately of the standard print step, suffering the inability to allow continuous printing of images of different patterns, and lowering notably the throughput of the image formation.

The method of (d) mentioned above seems to be an effective means because the construction which comprises providing an charging device adapted to charge the residual toner on the intermediate transfer member to a reversed polarity relative to the charged potential of the photosensitive member, and causing the residual toner on the intermediate transfer member to return to the photosensitive member solely by means of the charging device is very simple. Similarly to the method of (c), however, this method necessitates a cleaning step for removing the residual toner on the intermediate transfer member separately of the standard print step which implements the formation of an image.

Again in this case, therefore, the decline of throughput of the formation of image poses a problem.

Then, a failure to charge uniformly the residual toner on the intermediate transfer member prevents the residual toner on the intermediate transfer member from being electrostatically returned to the photosensitive member and results in incomplete cleaning, i.e. persistence of part of the residual toner on the intermediate transfer member.

Further, in the apparatus which, for improving the throughput of the formation of image, is constructed such that a next toner image on the photosensitive member is transferred onto the intermediate transfer member at the same time that the residual toner on the intermediate transfer member is returned electrostatically to the photosensitive member, the incomplete cleaning mentioned above constitutes itself a serious problem because it affects the next image.

SUMMARY OF THE INVENTION

This invention has an object of providing an image forming apparatus which is capable of repeating complete cleaning on the intermediate transfer member thereby permitting infallible preclusion of the otherwise possible persistence of residual toner.

This invention has another object of providing an image forming apparatus which is capable of improving the throughput of the formation of image while implementing complete cleaning of the intermediate transfer member and consequent thorough removal of the residual toner thereon.

DETAILED DESCRIPTION OF THE PREFERRED EMBODIMENTS

Figure 1:
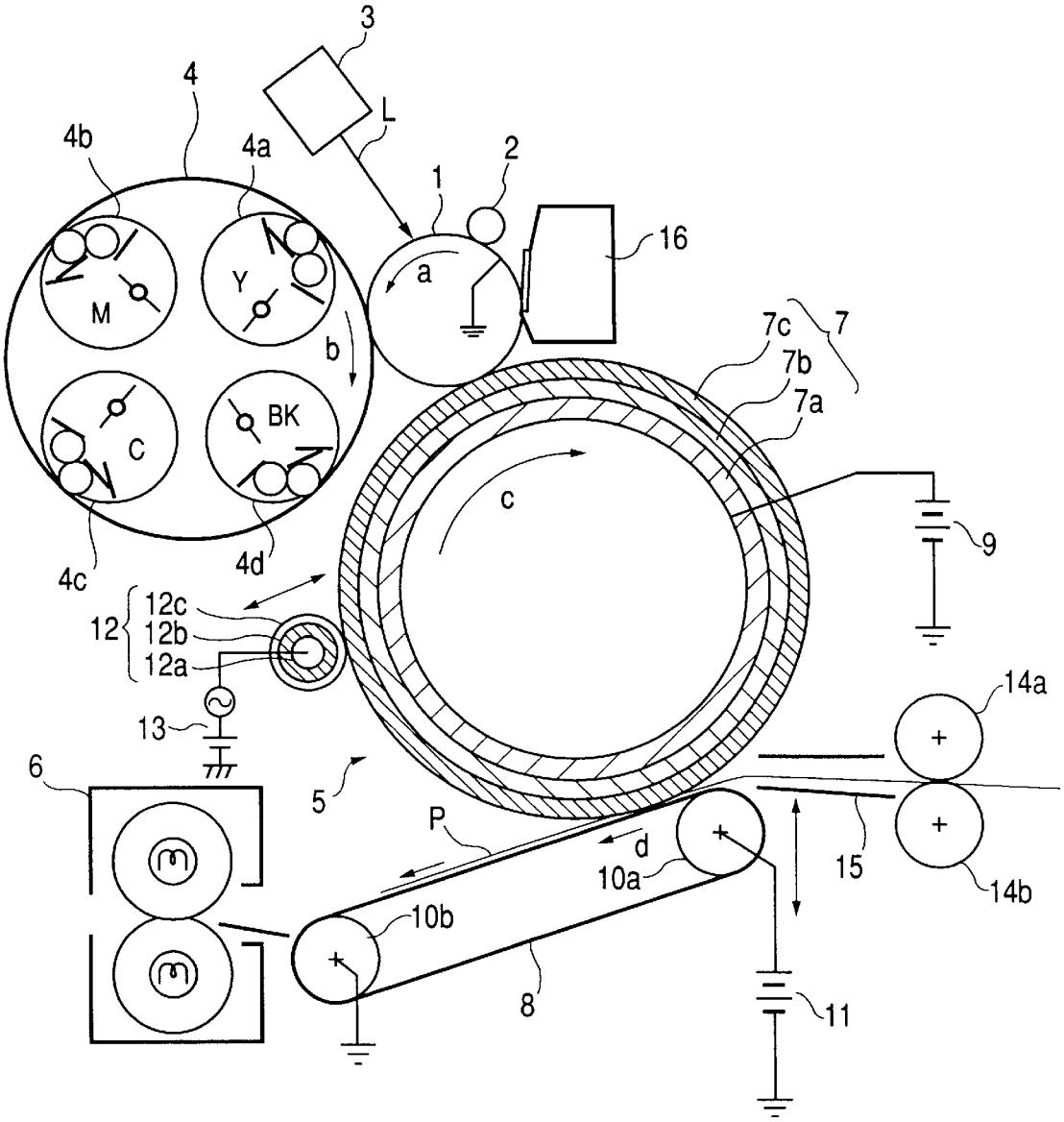
FIG. 1 is a schematic structural diagram illustrating an image forming apparatus according to an embodiment of this invention.

FIG. 1 is a schematic structural diagram illustrating in an image forming apparatus according to one embodiment of this invention (as embodied in a laser beam printer which is capable of forming a color image). This image forming apparatus comprises a photosensitive member 1 serving as an image bearing member, a charging roller 2, an exposure device 3, a developing device 4, a transfer device 5, a fixing device 6, etc.

The photosensitive member 1 in the present embodiment is a negatively charged organic photosensitive member which is provided on a drum substrate made of aluminum with a photoconductive layer and is rotated at a prescribed process speed in the direction of an arrow a.

The charging roller 2 is pressed with a prescribed pressing force against the surface of the photosensitive member 1, rotated by following the rotation of the photosensitive member 1, and consequently enabled to charge the photosensitive member 1 to the potential of a prescribed polarity (in the present embodiment, the negative polarity) by applying a prescribed bias voltage (in the present embodiment, such a voltage as has an AC voltage superimpose a DC voltage of negative polarity) from a power source (not shown) to the charging roller 2.

The developing device 4 is provided with a Y (yellow) developer 4*a*, a M (magenta) developer 4*b*, a C (cyan) developer 4*c*, and a BK (black) developer 4*d* respectively accommodating yellow, magenta, cyan, and black toners invariably charged to normally negative polarity and is rotated by a rotating device (not shown) in the direction of an arrow mark b. The Y developer 4*a*, M developer 4*b*, C developer 4*c*, and BK developer 4*d* are disposed such that they are sequentially opposed to the photosensitive member 1 during the process of development.

The transfer device 5 is provided with a roller-shaped intermediate transfer member 7 of a multilayer construction adapted to permit primary transfer thereto of a toner image formed on the photosensitive member 1 and a transfer belt 8 adapted to effect secondary transfer of the toner image on the intermediate transfer member 7 to the transfer material. The intermediate transfer member 7 which is composed of a conducting support member (core metal) 7*a* shaped like a pipe, an elastic layer 7*b* formed on the peripheral face thereof, and a coating layer 7*c* formed further thereon. It is adapted to contact the surface of the photosensitive member 1 at the position of primary transfer and also contact the surface of the transfer belt 8 at the position of secondary transfer and is rotated in the direction of an arrow mark c at substantially the same peripheral speed as the photosensitive member 1. A power source 9 as a means for the primary transfer is connected to the intermediate transfer member 7 and adapted to apply a prescribed primary transfer bias (DC voltage) to the intermediate transfer member 7.

The transfer belt 8 is stretched and suspended as passed around a transfer roller 10*a* as a means for the secondary transfer and a drive roller 10*b*. The rotation of the drive roller 10*b* moves the upper surface of the belt in the direction of an arrow mark d. The transfer belt 8 is adapted to make and break contact with the intermediate transfer member 7 by a drive means (not shown). A power source is connected to the transfer roller 10*a* and adapted to apply a prescribed secondary transfer bias (DC voltage) to the transfer roller 10*a*.

On the outer peripheral surface of the intermediate transfer member 7, a roller of a multilayer construction intended as an charging member for imparting an electric charge to the toner remaining on the intermediate transfer member 7 after the secondary transfer (hereinafter referred to briefly as "ICL roller") is disposed so as to make and break contact arbitrarily therewith. To the intermediate transfer member 7, a power source 15 applies a prescribed bias voltage (in the present embodiment, such a voltage as has an AC voltage superimpose a DC voltage of the reversed polarity (positive polarity) relative to the polarity of the normal toner in the developing device 4). The ICL roller 12 is composed of a conducting support member (core metal) 12*a*, an elastic layer 12*b* formed on the peripheral surface thereof, and a coating layer 12*c* formed further thereon.

Now, the operation of the image forming apparatus described above will be explained.

During the formation of an image, the photosensitive member 1 is rotated at a prescribed process speed by a drive means (not shown) and charged to a polarity (negative polarity) and a potential both of prescribed magnitudes by the charging roller 2 having a prescribed charging bias (in the present embodiment, such a voltage as has a DC voltage superimpose a DC voltage of the negative polarity) applied thereto. On the charged photosensitive member 1, an electrostatic latent image conforming to the first color component image (an yellow component image, for example) of a given color image is formed in consequence of the projection of an image light L of laser beam emitted by the exposure device 3 onto the photosensitive member 1. Then, this electrostatic latent image is developed with a yellow toner which is the first color component by the Y (yellow) developer 4*a*.

The yellow toner image of the first component color mentioned above which has been formed and deposited on the photosensitive member 1, during the process of passing the nip part between the photosensitive member 1 and the intermediate transfer member 7, is made to effect primary transfer thereof to the peripheral surface of the intermediate transfer member 7 by virtue of the pressure developed in the nip part and the electric field formed by the primary transfer bias applied by the power source 9 to the intermediate transfer member 7. In the same manner thereafter, the magenta toner image of the second component color, the cyan toner image of the third component color, and the black toner image of the fourth component color which are formed and deposited on the photosensitive member 1 respectively by the M (magenta) developer 4*b*, the C (cyan) developer 4*c*, and the BK (black) developer 4*d* are sequentially transferred as superposed on the intermediate transfer member 7 to complete a synthetic color toner image corresponding to the given color image. This step will be referred to hereinafter as "primary transfer".

In this case, the primary transfer bias which is applied from the power source 9 for the purpose of the sequential superposing transfer of the first through fourth color toner images from the photosensitive member 1 to the intermediate transfer member 7 has the reversed polarity (positive) relative to the polarity of the toner. While the sequential superposing transfer of the first through fourth color toner images from the photosensitive member 1 to the intermediate transfer member 7 is in process, the transfer belt 8 and the ICL roller 12 are separated from the intermediate transfer member 7.

Then, a transfer material P such as a sheet which has discharged from a feed sheet cassette (not shown) is passed between regist rollers 14*a* and 14*b* and through a pre-transfer guide 15 and fed to a transfer nip part (near the transfer roller 10*a*) formed between the intermediate transfer member 7 and the transfer belt 8. In this while, a power source 11 applies a secondary transfer bias (DC voltage) to the transfer roller 10*a* to effect transfer of a synthetic color toner image from the intermediate transfer member 7 onto the transfer material P. This step will be referred to hereinafter as "secondary transfer".

The transfer material P having the synthetic color toner image transferred thereto is conveyed by the transfer belt 8 to the fixing device 6, heated thereby to have the toner image fixed thereon, and then discharged.

The secondary transfer residual toner which remains on the intermediate transfer member 7 after surviving the secondary transfer is converted to a positive polarity by the ICL roller 12 to which a prescribed bias (in the present embodiment, such a voltage as has an AC voltage superimpose a DC voltage of the reversed polarity (positive polarity) relative to the polarity of the normal toner in the developing device 4) has been applied from a power source 13. This toner is then electrostatically transferred to the photosensitive member 1 in response to the application of a prescribed voltage (positive polarity) from the power source 9 to the intermediate transfer member 7. As a result, the surface of the intermediate transfer member 7 is cleaned. At this time, the ICL roller 12 is already in contact with the intermediate transfer member 7. The secondary transfer residual toner adsorbed on the photosensitive member 1 is subsequently recovered by a cleaning device 16. At this time, a prescribed primary transfer bias (positive polarity) is applied to the intermediate transfer member 7 where the residual toner on the intermediate transfer member 7 is transferred to the photosensitive member 1 at the same time that the toner image on the photosensitive member 1 is transferred to the intermediate transfer member 7. Though the present embodiment, as depicted above, utilizes the ICL roller 12 to charge the residual toner to the positive polarity, the toner may be charged to the negative polarity instead. In this case, the residual toner is transferred to the photosensitive member 7 by the fact that the power source 9 applies a voltage of the negative polarity to the residual toner.

The inventors have experimentally found that the transferring property and the cleaning property expected in the apparatus of the present embodiment can be stably retained for a long time by using the ICL roller 12 having applied thereto such a voltage as has an AC voltage superimpose a DC voltage of positive polarity for the purpose of imparting an electric charge to the residual toner on the intermediate transfer member 7 after the secondary transfer and adjusting the sum of the surface roughness of this ICL roller 12 and that of the intermediate transfer member 7 to a level of not less than 1 $\mu$m and not more than 50 $\mu$m.

In contrast, it is only the outermost surface part of the layer of the residual toner that is subjected to electrification where the residual toner on the intermediate transfer member 7 is charged exclusively by the application of a DC voltage of positive polarity to the ICL roller 12. As a consequence, the surface part of the toner layer is occupied by toner particles of high positive charge and the inner part thereof is occupied by toner particles which have not been much subjected relatively to electrification. An attempt to clean out the toner layer in such a state entrains the following two problems which pertain to incomplete cleaning and ghost.

(Incomplete cleaning)

The toner particles of the inner part of the toner layer which have passed the ICL roller 12 and have not been much subjected relatively to electrification induce the next image to incur incomplete cleaning. Specifically, the cleaning is effected by causing the positively charged residual toner to be recovered on the photosensitive member 1 by the electric field between the photosensitive member 1 and the intermediate transfer member 7. So, the toner which possesses a weak positive or negative charge is not recovered but suffered to manifest as a positive ghost of incomplete cleaning in the wholly black part of the next image and constitute itself a serious defect of image.

(Negative ghost)

The outermost surface part of the layer of the toner which has passed the ICL roller 12 has been intensely charged and the consequent charge is so high as to reach a level exceeding +50 $\mu$c/g. This toner is such that the charge of the toner of the next image which is simultaneously subjected to primary transfer and cleaned out in the primary transfer nip (position of primary transfer) between the photosensitive member 1 and the intermediate transfer member 7 is only on the order of 10 $\mu$c/g where the black toner to be used is a magnetic toner.

The toner of this quality, therefore, is electrostatically adsorbed on the toner which is possessed of intense positive charge and destined to be cleaned out, so that the adsorbed toner is returned to the photosensitive member 1 instead of being subjected to the primary transfer to the intermediate transfer member 7. When the toner is elected to form a solid black image, therefore, the toner of the part corresponding to the preceding image is inevitably returned to the photosensitive member 1 and suffered to generate a difference in density and manifest itself as a negative ghost. To be specific, the influence which the secondary transfer residual toner has on the image is large even when the amount of the toner is small because one part of the secondary transfer residual toner which has passed the ICL roller 12 of +50 μc/g induces the phenomenon of negative ghost by entraining five parts of the toner to be subjected to the primary transfer onto the intermediate transfer member 7 from the photosensitive member 1 of −10 μc/g.

This phenomenon is effectively prevented by a measure which comprises decreasing the electric current passed to the ICL roller 12 and reducing the electric charge imparted to the outermost surface part of the layer of the secondary transfer residual toner. When this measure is adopted, however, the incomplete cleaning is inevitably aggravated because the toner particles in the inner part of the layer of the secondary transfer residual toner are not charged.

The incomplete cleaning and the negative ghost contradict each other as described above. The region in which they are both solved satisfactorily cannot be found because the negative ghost grows in severity in proportion as the electric current passed to the ICL roller 12 increases and the incomplete cleaning gains in seriousness in accordance as the electric current decreases. This phenomenon becomes prominent in a circumstance of high humidity in which the charge of the toner to be developed is lowered or in a magnetic toner of inherently low charge, e.g. a black toner in the present embodiment. Under the circumstance of high humidity, the discharge becomes increasingly difficult to occur, the toner cannot be charged to positive polarity, and the phenomenon of incomplete cleaning is liable to result because the intermediate transfer member 7 and the ICL roller 12 which possess medium registance have the registance degraded on absorbing moisture and, even while passing a fixed amount of electric current, have essentially the whole current directly injected therein.

At the same time under the circumstance of high humidity under which the toner in the developing device has the magnitude of registance thereof degraded on absorbing moisture, especially so where the toner in use has a magnetic quality, the phenomenon of negative ghost is aggravated because this toner suffers the charge of electrification to decline and succumbs to adsorption at the position of primary transfer to the secondary transfer residual toner on the intermediate transfer member 7 which has been charged to positive polarity by the ICL roller 12. Thus, the number of toner particles which inevitably return ultimately to the photosensitive member 1 increases.

For the purpose of solving these two problems, it is necessary to uniformize the electric charge of the secondary transfer residual toner which occurs after the passage of the ICL roller 12. These problems can be solved by having the whole secondary transfer residual toner charged to positive polarity. This is because the toner particles of intense positive charge in the outermost surface part of the layer of the secondary transfer residual toner occurring after passage of the ICL roller 12 induce the negative ghost and the toner particles of weak charge in the inner part of the layer induce the incomplete cleaning. To realize this uniform electrification, the present embodiment contemplates obtaining the bias of electrification for application to the ICL roller 12 by having an AC voltage superimpose a DC voltage of negative polarity such that the sum of the surface roughness, Rz, of the ICL roller 12 and that of the intermediate transfer member 7 reaches a level of not less than 1 μm and not more than 50 μm.

Concisely, the application of the AC voltage serves the purpose of exiting not only the discharge from the ICL roller 12 but also the discharge from the intermediate transfer member 7 and enabling the electric field to extend to the inner part of the layer of the secondary transfer residual toner. When the AC voltage so applied is increased in magnitude, since the flight of toner particles begins to occur between the ICL roller 12 and the intermediate transfer member 7, the mutual displacement of toner particles arises in the layer of the secondary transfer residual toner, the electrification is enabled to proceed more uniformly, and the flight has an effect of dispersing the secondary transfer residual toner, and the prevention of the negative ghost is promoted further as well. Here, the AC voltage is preferred to have the shape of a rectangular wave which, unlike the sine wave, is capable of retaining a long time axis of peaks and consequently producing efficient electrification and flight of the secondary transfer residual toner at a low peak-to-peak voltage. The present embodiment, as depicted above, has the ICL roller 12 charge the transfer residual toner by contacting the intermediate transfer member 7, it allows the ICL roller 12 and the intermediate transfer member 7 to remain apart to an extent such that the flight of toner is allowed to occur. The separate retention of these two components, however, is at a disadvantage by requiring to increase the voltage applied to the ICL roller 12 as compared with the retention in contact.

When the ICL roller 12 and the intermediate transfer member 7 both have a course surface, however, they generate local discharge and fail to effect uniform electrification of the secondary transfer residual toner, so that no stable cleaning will be attained. The discharge occurs between the protrusions of the ICL roller 12 and the projections of the intermediate transfer member 7 in all the jogging parts of the surfaces of the ICL roller 12 and the intermediate transfer member 7 and the transfer residual toner existing in the depressions of the intermediate transfer member 7 result in incomplete electrification. To be specific, there are times when the full-color mode which is productive of the secondary transfer residual toner in a relatively large amount fails to effect fully satisfactory cleaning, whereas the monocolor mode which produces the secondary transfer residual toner in a relatively small amount permits fully satisfactory cleaning.

The prevention of the disadvantage mentioned above requires the sum of the surface roughness, Rz, of the ICL roller 12 and that of the intermediate transfer member 7 to be not more than 50 μm. Particularly, the rough surface of the intermediate transfer member 7 has the possibility of entraining such defects as lowering the efficiency of the secondary transfer and imparting ruggedness to the produced image. At the same time, suffering the amount of the secondary transfer residual toner to be increased by the decrease in the efficiency of the secondary transfer and also suffering the transfer residual toner escaping complete cleaning to be accumulated on the intermediate transfer member 7, so that the accumulated residual toner will bring about such disadvantages as manifesting a clear sign of incomplete cleaning on images produced in continuous quantity printing and giving rise to the phenomenon of filming of the surface of the intermediate transfer member 7.

For the purpose of precluding these disadvantages, the surface roughness, Rz, of the intermediate transfer member 7 is required to be not more than 30 μm. If the sum of the surface roughness, Rz, of the ICL roller 12 and that of the intermediate transfer member 7 is not more than 1 μm, the problem arises that the toner will manifest poor separability from the intermediate transfer member 7 and the efficiency of the secondary transfer will be degraded. Further, if the sum of Rz mentioned above is not more than 1 μm where the ICL roller 12 happens to be a roller that is rotated by following the rotation of the intermediate transfer member 7, the cleaning will no longer be allowed to proceed stably because the ICL roller 12 and the intermediate transfer member 7 slip over each other and the secondary transfer residual toner is not uniformly charged. The term "surface roughness" as used herein means the ten-point average roughness, Rz. The surface roughness, Rz, of the ICL roller 12 and that of the intermediate transfer member 7 which are mentioned herein refer to the numerical values obtained by a test to be conducted in accordance with JIS (Japanese Industrial Standard) B0601, with necessary modifications.

Now, the construction of the intermediate transfer member 7 and that of the ICL roller 12 mentioned above will be described in detail below.

The intermediate transfer member 7 is provided on the cylindrical conducting support member 7*a* made of stainless steel with the elastic layer 7*b* and further thereon with the coating layer 7*c*. The thickness of the elastic layer 7*b* is preferred to exceed 0.5 mm, particularly to fall in the approximate range of 1–5 mm, in consideration of such factors as the formation of a transfer nip, the misregister of color due to rotation, and the cost of material. The thickness of the coating layer 7*c* is preferred to be not more than 500 μm, especially to be in the approximate range of 5–100 μm, for the purpose of transmitting the flexibility of the elastic layer 7*b* as the lower layer to the surface of the photosensitive member 1.

The ICL roller 12 likewise is provided on a cylindrical conducting support member 12*a* made of stainless steel with an elastic layer 12*b* and further thereon with a coating layer 12*c*. The thickness of the elastic layer 12*b* is preferred to be not less than 0.5 mm, especially to be in the approximate range of 1–5 mm and the thickness of the coating layer 12*c* is preferred to be not more than 500 μm, especially to be in the approximate range of 5–100 μm for the purpose of preventing the flexibility of the elastic layer 12*b* as the lower layer from being impaired. This invention contemplates providing the intermediate transfer member 7 and the ICL roller 12 with surfaces such that the surface roughness, Rz, of the intermediate transfer member 7 is not more than 30 μm and the sum of the surface roughness, Rz, of the intermediate layer 7 and that of the ICL roller 12 is not less than 1 μm and not more than 50 μm (the manufacture of these components provided with such surfaces as mentioned above will be described specifically herein below).

The elastic layers 7*b* and 12*b* and the coating layers 7*c* and 12*c* respectively of the intermediate transfer member 7 and the ICL roller 12 can be made of rubber, elastomer, or resin.

As concrete examples of the rubber or elastomer to be used effectively herein, natural rubber, isoprene rubber, styrene-butadiene rubber, butadine rubber, butyl rubber, butadiene rubber, ethylene-propylene rubber, chloroprene rubber, chloro-sulfonated polyethylene, chlorinated polyethylene, acrylonitrile-butadiene rubber, urethane rubber, syndiotactic 1,2-polybutadiene, epichlorohydrin rubber, acryl rubber, silicone rubber, fluorine rubber, polynorbornene rubber, hydride nitrile rubber, and thermoplastic elastomers (such as, for example, polystyrene type, polyolefin type, polyvinyl chloride type, polyurethane type, polyamide type, polyester type, and fluorine resin type elastomers) may be cited.

As concrete examples of the resin to be effectively used herein, polystyrene, chloropolystyrene, poly-α-methyl styrene, styrene-butadiene copolymer, styrene-vinyl chloride copolymer, styrene-vinyl acetate copolymer, styrene-maleic acid copolymer, styrene-acrylic ester copolymers (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylic ester copolymers (such as styrene-methyl methacrylate copolymer, styrene-ethyl methacrylate copolymer, and styrene-phenyl methacrylate), styrene resins (homopolymers or copolymers containing styrene or styrene substituents) such as styrene-α-methyl chloroacrylate copolymer and styrene-acrylonitrile-acrylic ester copolymers, methyl methacrylate resin, butyl methacrylate resin, ethyl acrylate resin, butyl acrylate resin, modified acryl resins (silicone-modified acryl resin, vinyl chloride-modified acryl resin, fluorine-modified acryl resin, and acryl·urethan resin), vinyl chloride resin, styrene-vinyl acetate copolymer, vinyl chloride-vinyl acetate copolymer, resin-modified maleic acid resin, phenol resin, epoxy resin, polyester resin, polyurethane resin, polyethylene, polypropylene, polybutadiene, polyvinylidene chloride, ionomer resin, silicone resin, fluorine resin, ketone resin, ethylene-ethyl acrylate copolymer, xylene resin, polyvinyl butyral resin, polyamide resin, and modified polyphenylene oxide resin may be cited, though not exclusively. These resins may be used either singly or in the form of a copolymer of two or more members.

The elastic layers 7*b* and 12*b* and the coating layers 7*c* and 12*c* respectively of the intermediate transfer member 7 and the ICL roller 12 can incorporate as dispersed therein conducting materials such as carbon black, graphite, carbon fibers, metal powder, conducting metal oxide, organic metal oxide, organic metal salt, or conducting polymers for the purpose of adjusting the electric registance thereof. They can further incorporate as dispersed therein resin powder or inorganic powder for the purpose of preventing adhesion of toner.

For the conducting support members 7*a* and 12*a* of the intermediate transfer member 7 and the ICL roller 12, such a resin as is endowed with conductivity by having dispersed therein a metal such as aluminum, iron, or stainless steel, carbon, or metal powder can be used.

The electric registance of the intermediate transfer member 7 is preferred to be in the range of $10^3$–$10^{10}\Omega$ (real registance), particularly in the range of $10^4$–$10^9\Omega$. The intermediate transfer member 7 is required to possess fully satisfactory surface registance for the purpose of effecting discharge by contacting the ICL roller 12. The magnitude of the surface registance which is effective herein is in the range of $10^6$–$10^{15}\Omega/\square$ (determined under the conditions of normal room temperature, normal humidity, and application of 250 V). The methods for determining the real registance and the surface registance of the intermediate transfer member 7 will be described specifically herein below.

The electric registance of the ICL roller 12 is preferred to be in the range of $10^3$–$10^{12}\Omega$ (real registance), more advantageously in the range of $10^5$–$10^{10}\Omega$ (real registance). Further, the ICL roller 12 is required to possess such surface registance as suffices to effect discharge on contacting the intermediate transfer member 7. The magnitude of the surface registance which is effective herein is in the range of $10^6$–$10^{15}\Omega/\square$ (determined under the conditions of normal room temperature, normal humidity, and application of 250 V). The reduction of the surface roughness, Rz, of the intermediate transfer member 7 and that of the ICL roller 12 can be accomplished by such methods as grinding the surface parts of the intermediate transfer member 7 and the ICL roller 12, devising the composition of a solvent to be used in applying the coating layers 7*b* and 12*c* of the intermediate transfer member 7 and the ICL roller 12, devising the conditions for drying the coating layers 7*b* and 12*c*, and devising the method of application of the coating layers 7*b* and 12*c*, for example. The methods for determining the real registance and the surface registance of the ICL roller 12 will be specifically described herein below.

The methods which are available for grinding the surfaces of the intermediate transfer member 7 and the ICL roller 12 include a method which resorts to use of a grinder, a method which works a surface with a belt abrader, and a method which works a surface with a barrel, for example. As concerns the method for devising the solvent to be used in applying the coating layers 7*b* and 12*c* of the intermediate transfer member 7 and the ICL roller 12, the adoption of a solvent with low volatility tends to allay the roughness of surface where the surfaces of the intermediate transfer member 7 and the ICL roller 12 are coarsened with relatively small pitches.

The methods which are available for applying the coating layers 7*b* and 12*c* to the intermediate transfer member 7 and the ICL roller 12 include dipping method, spray coating method, spinner coating method, bead coating method, blade coating method, beam coating method, and roll coating method, for example.

Figure 2:
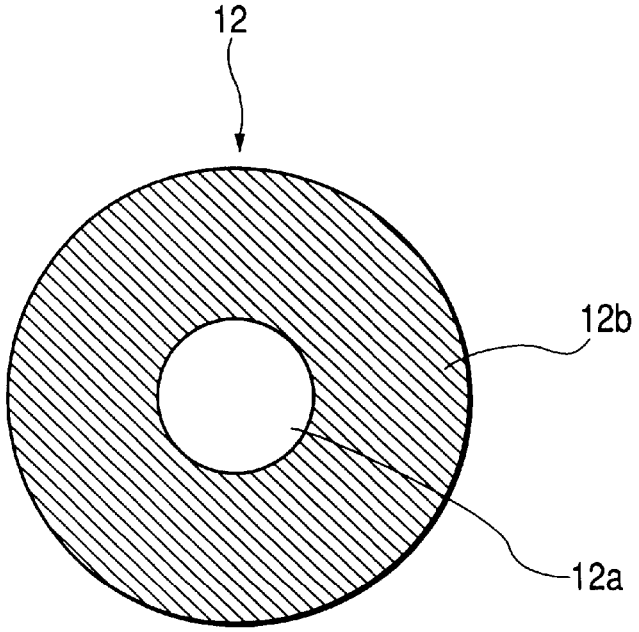
FIG. 2 is a cross section illustrating one example of the ICL roller in the image forming apparatus according to the embodiment of this invention.
Figure 3:
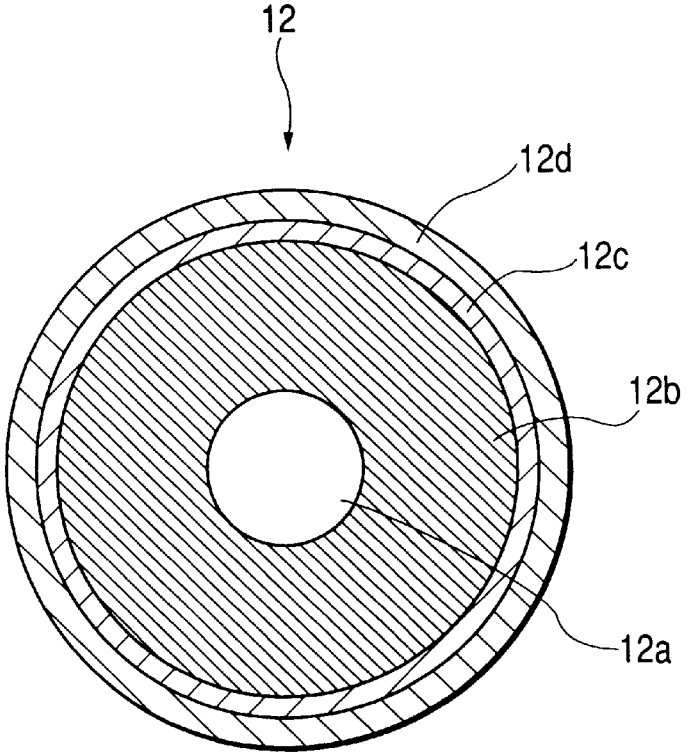
FIG. 3 is a cross section illustrating another example of the ICL roller in the image forming apparatus according to the embodiment of this invention.

The ICL roller 12, as depicted above, is provided on the conducting support member (core metal) 12*a* with the elastic layer 12*b* and the coating layer 12*c*. Otherwise, the ICL roller 12 of a single-layer construction which is provided on the conducting support member (core metal) 12*a* exclusively with the elastic layer 12*b* as illustrated in FIG. 2 or the ICL roller 12 of a multilayer construction which is provided on the elastic layer 12*b* overlying the conducting support member (core metal) 12*a* with two (or more) coating layers 12*c* and 12*d* as illustrated in FIG. 3, for example, may be used.

Figure 4:
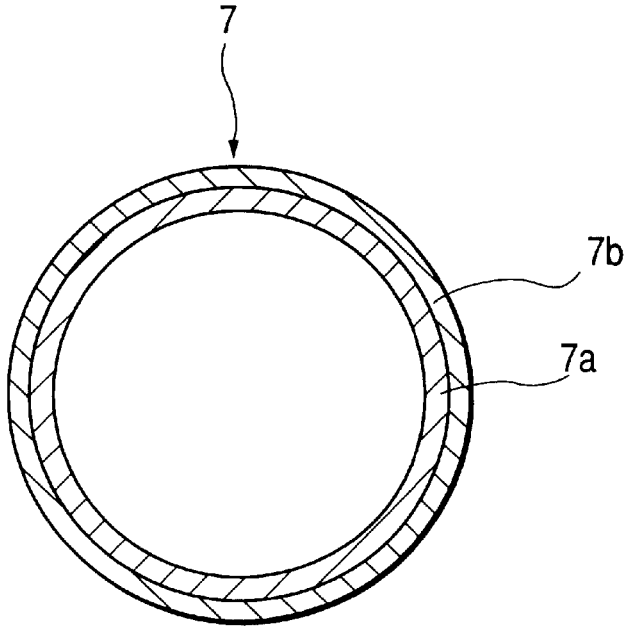
FIG. 4 is a cross section illustrating one example of the intermediate transfer member in the image forming apparatus according to the embodiment of this invention.
Figure 5:
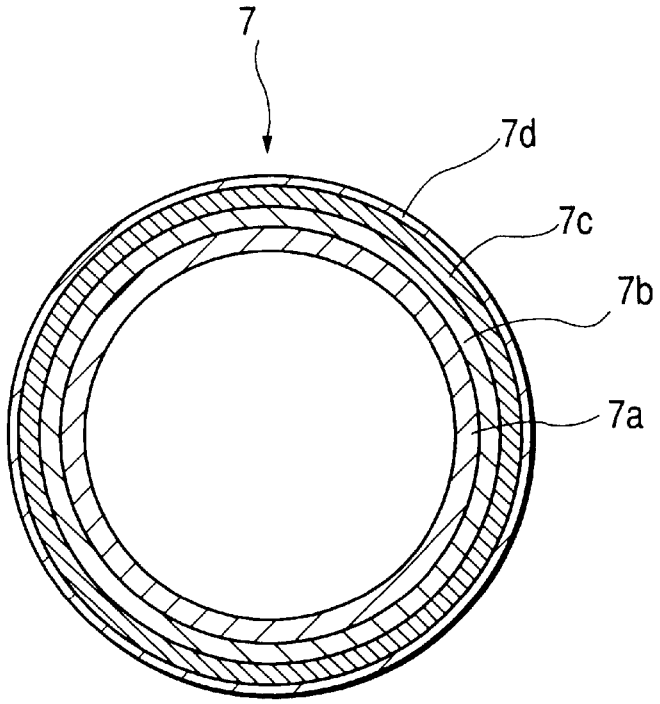
FIG. 5 is a cross section illustrating another example of the intermediate transfer member in the image forming apparatus according to the embodiment of this invention.

The intermediate transfer member, as depicted above, is provided on the conducting support member (core metal) 7*a* with the elastic layer 7*b* and the coating layer 7*c*. Otherwise, the intermediate transfer member 7 of a single-layer construction which is provided on the conducting support member (core metal) 7*a* exclusively with the elastic layer 7*b* as illustrated in FIG. 4 or the intermediate transfer member of a multilayer construction which is provided on the elastic layer 7*b* overlying the conducting support member (core metal) 7*a* with two (or more) coating layers 7*c* and 7*d* as illustrated in FIG. 5, for example, may be used.

Figure 6:
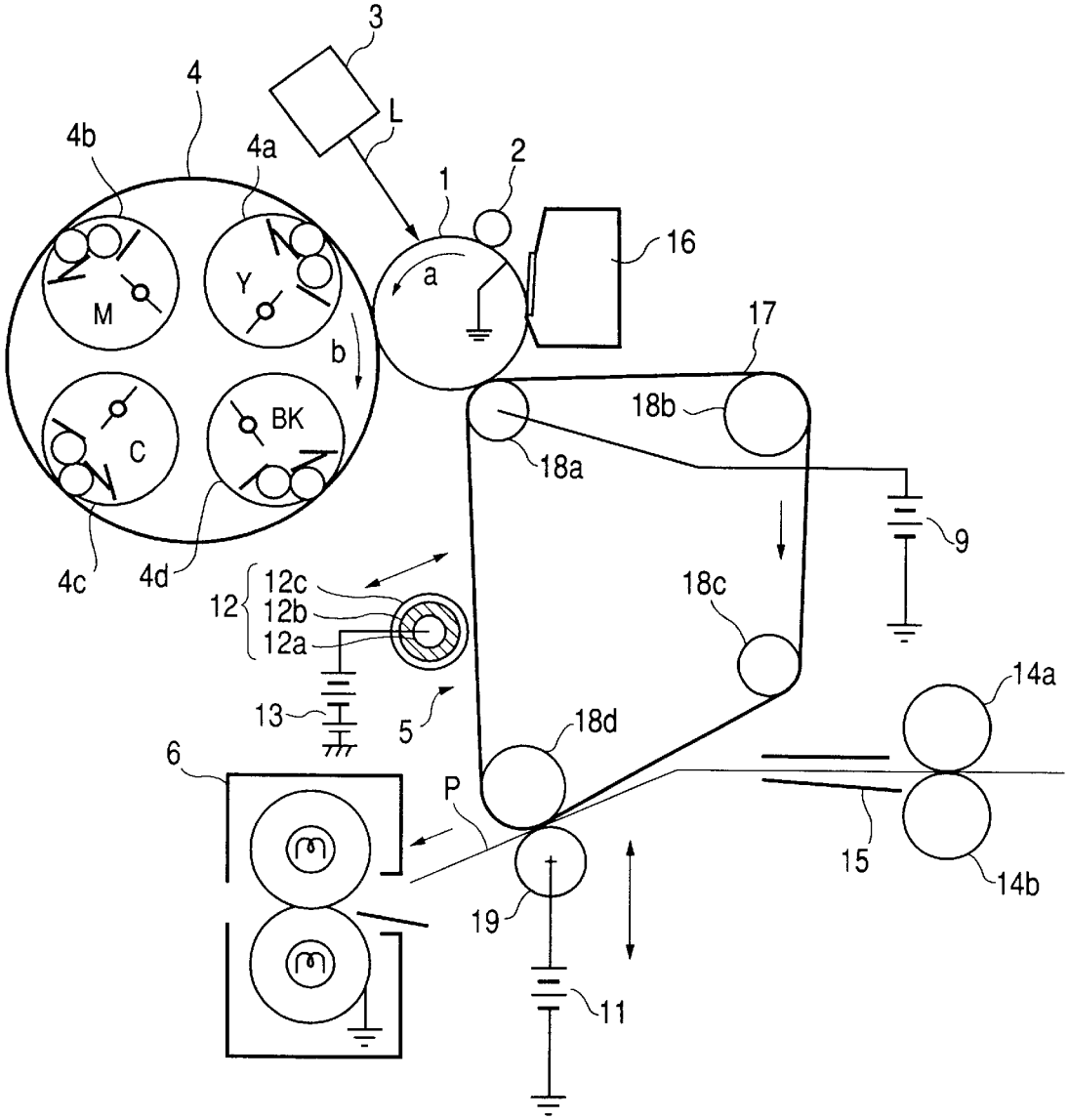
FIG. 6 is a schematic structural diagram illustrating an image forming apparatus according to such an embodiment of this invention as is provided with an intermediate transfer member formed in the shape of a belt.

Alternatively, an intermediate transfer member 17 which, as used in the image forming apparatus (a laser beam printer capable of forming a color image) illustrated in FIG. 6, is formed in the shape of a belt provided on an elastic layer with a coating layer may be used. Incidentally, the belt-shaped intermediate transfer member 17 is stretched and suspended as passed around four rollers 18*a*, 18*b*, 18*c*, and 18*d*. To the roller 18*a* to which the power source 9 is connected, a prescribed primary transfer bias (DC voltage) is applied. The reference numeral 19 represents a transfer roller, with the exception of which the image forming apparatus is identical with the image forming apparatus illustrated in FIG. 1.

The throughput of the operation of continuous formation of images can be improved by charging the transfer residual toner on the intermediate transfer member 7 to negative polarity by the ICL roller 12 subsequently to the secondary transfer of the full-color image on the intermediate transfer member 7 to the transfer material and then applying the prescribed primary transfer bias (positive polarity) from the power source 9 to the intermediate transfer member 7. Thus, the primary transfer of the toner image of the first component color of the next image on the photosensitive member 1 to the intermediate transfer member 7 is effected at the same time that the transfer residual toner on the intermediate transfer member 7 is transferred to the photosensitive member 1 (simultaneous primary transfer and cleaning). At this time, the aforementioned transfer residual toner which has been transferred onto the photosensitive member 1 is recovered by the cleaning device 16. For the purpose of the simultaneous primary transfer and cleaning, it is necessary to charge the transfer residual toner to negative polarity, i.e. the reversed polarity relative to the polarity of the normal toner on the photosensitive member 1 (disposed inside the developing device 4), by means of the ICL roller 12.

The adoption of this construction can be expected to promote the prevention of the occurrence of incomplete cleaning and negative ghost and the improvement of the throughput of the image formation as well. Further, this construction obviates the necessity for providing the intermediate transfer member with a waste toner receptacle and, as a consequence, can contribute to miniaturize the apparatus as a whole.

Now, the manufacture of the ICL roller 12 and the intermediate transfer members 7 and 17 mentioned above will be described in detail below.

(EXAMPLE 1)

Manufacture of ICL roller

A roller possessed of an elastic layer, 3 mm in thickness, was obtained by transfer forming a compound of the following composition by the use of a die on a core metal of stainless steel, 14 mm in diameter and 340 mm in length.

Rubber composition

NBR rubber 100 parts by weight

Vulcanizer (sulfur) 0.5 part by weight

Vulcanization auxiliary (zinc white) 3 parts by weight

Vulcanization accelerator (thiuram type) 2 parts by weight

Conducting agent (carbon black) 25 parts by weight

Dispersion auxiliary (stearic acid) 1.5 parts by weight

Plasticizer (naphthene type process oil) 30 parts by weight

Then, a paint for producing a coating layer on the roller was manufactured by the following formula.

Paint composition

One-component type polyurethane 100 parts by weight

Polyethylene resin particles 50 parts by weight

Conducting tin oxide 20 parts by weight

Xylene 500 parts by weight

An ICL roller possessing a coating layer, 50 $\mu$m in thickness, was obtained by applying the paint by dipping to the roller mentioned above, drying the resultant coating layer at 60° C. for 30 minutes, and drying it at 130° C. for two hours to expel the residual solvent. The surface roughness, Rz, of the produced ICL roller was 10 $\mu$m. The real registance thereof was $2\times10^{8}\Omega$ and the surface registance thereof was $3\times10^{12}\Omega/\square$. The numerical value of the surface roughness, Rz, of the ICL roller indicated herein was determined in accordance with the method specified in JIS B0601 with necessary modifications.

Figure 7:
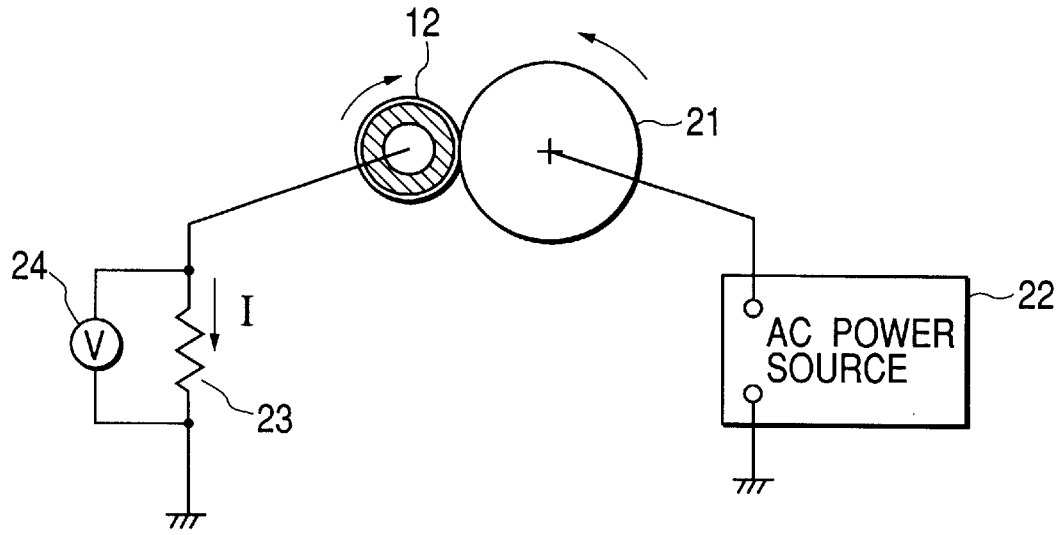
FIG. 7 is a schematic diagram illustrating a measuring device for measuring the actual registance of an ICL roller.

The real registance of the ICL roller was determined by the use of a measuring device illustrated in FIG. 7. This measuring device was provided with a metal roll (50 mm in outside diameter) 21 adapted to contact the ICL roller 12, a DC power source 22, a registor 23, and a potentiometer 24. The measurement was carried out under the conditions of normal room temperature and normal humidity.

During the determination of the real registance of the ICL roller, the metal roll 21 was rotated by a drive device (not shown) and the ICL roller 12 held in contact therewith was made to follow the rotation thereof. The pressure of this contact was set at about 1 kgf similarly in the actual formation of an image. Then, a constant DC voltage of 100 V from the DC power source 22 was applied to the metal roll 21 and the potential difference between the opposite terminals of the registor 23 possessed of a known registance amply lower than the registance of the ICL roller 12 under test and inserted on the downstream side of the ICL roller 12 was read on the potentiometer 24. The current I in flow was computed from the potential difference obtained at the opposite terminals of the registor 23. The quotient of the found magnitude of the current I divided by the applied voltage of 100 V was reported as the real registance of the ICL roller 12.

The surface registance of the ICL roller 12 was determined by the use of an instrument (produced by Mitsubishi Yuka K.K. and marketed under trademark designation of "Hiresta" and fitted with a HA probe) under an applied voltage of 250 V under the conditions of normal room temperature and normal humidity.

Manufacture of intermediate transfer member

A roller possessed of an elastic layer, 5 mm in thickness, was obtained by transfer forming a compound of the following composition by the use of a die on the surface of a cylindrical roller of aluminum, 182 mm in diameter, 320 mm in length, and 5 mm in wall thickness.

Rubber composition

EPDM 100 parts by weight

Vulcanizer (sulfur) 1 part by weight

Vulcanization auxiliary (zinc white) 3 parts by weight

Vulcanization accelerator (thiuram type) 1.5 parts by weight

Conducting agent (carbon black) 10 parts by weight

Dispersion auxiliary (stearic acid) 1 part by weight

Plasticizer (naphthene type process oil) 20 parts by weight

Then, a paint for obtaining a coating layer on the roller was manufactured by the following formula.

Paint composition

Methoxymethylated nylon 100 parts by weight

Ethylene tetrafluoride resin particles 50 parts by weight

Conducting titanium oxide 10 parts by weight

Ethanol 260 parts by weight

Xylene 140 parts by weight

Citric acid 2 parts by weight

An intermediate transfer member possessed of a coating layer, 50 $\mu$m in thickness, was obtained by applying the paint by dipping to the roller mentioned above, drying the applied layer of the paint at 60° C. for 30 minutes, and drying to hardness the layer at 130° C. for two hours. The surface roughness, Rz, of the produced intermediate transfer member was 13 $\mu$m. The real registance thereof was $1\times10^{7}\Omega$ and the surface registance thereof was $5\times10^{12}\Omega/\square$. Here, the surface roughness, Rz, of the intermediate transfer member was determined in accordance with the method specified in JIS B0601 with necessary modifications.

Figure 8:
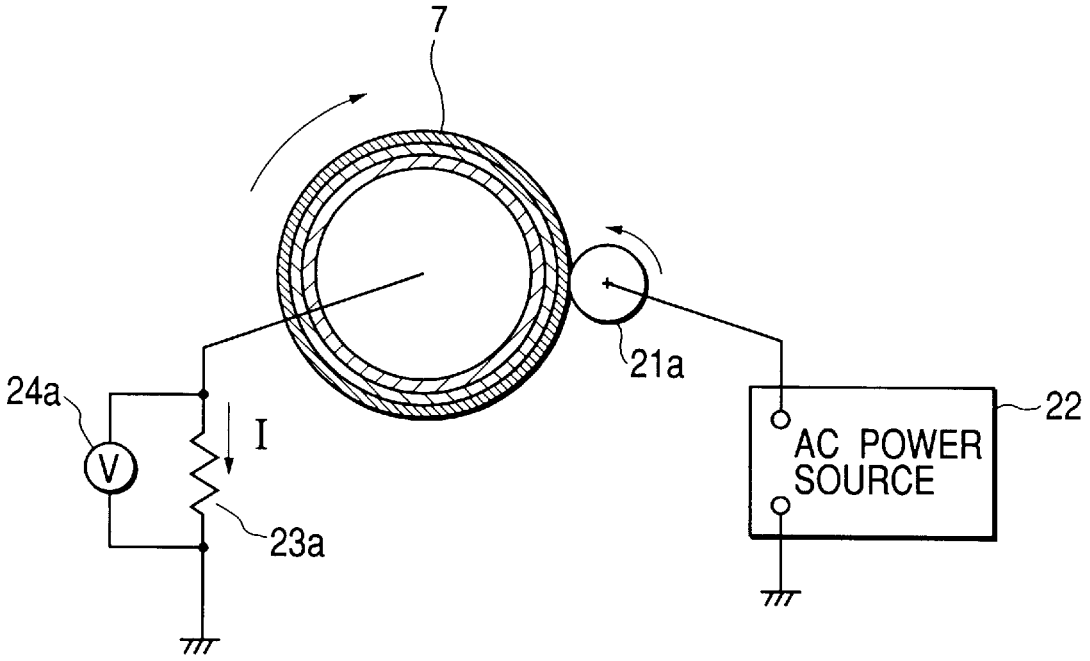
FIG. 8 is a schematic diagram illustrating a measuring device for measuring the actual registance of an intermediate transfer member.

The real registance of the intermediate transfer member was determined by the use of a measuring device illustrated in FIG. 8. This measuring device was provided with a metal roll (40 mm in outside diameter) 21*a* adapted to contact the intermediate transfer member 7, a DC power source 22*a*, a registor 23*a*, and a potentiometer 24*a*. The measurement was carried out under the conditions of normal room temperature and normal humidity.

During the determination of the real registance of the intermediate transfer member, the metal roll 21*a* was rotated by a drive device (not shown) such that the intermediate transfer member 7 held in contact therewith followed the rotation thereof at a peripheral speed of 100 mm/sec. The pressure of this contact was set at about 2 kgf similarly in the actual formation of an image. Then, a constant DC voltage of 1 kV from the DC power source 22 was applied to the metal roll 21*a* and the potential difference between the opposite terminals of the registor 23*a* possessed of a known registance amply lower than the registance of the intermediate transfer member 7 under test and inserted on the downstream side of the intermediate transfer member 7 was read on the potentiometer 24*a*. The current I in flow was computed from the potential difference obtained at the opposite terminals of the registor 23*a*. The quotient of the found magnitude of the current I divided by the applied voltage of 1 kV was reported as the real registance of the intermediate transfer member 7.

The surface registance of the intermediate transfer member 7 was determined by the use of an instrument (produced by Mitsubishi Yuka K.K. and marketed under trademark designation of "Hiresta" and fitted with a HA probe) under an applied voltage of 250 V under the conditions of normal room temperature and normal humidity.

Then, the ICL roller 12 and the intermediate transfer member 12 manufactured above were installed in the image forming apparatus illustrated in FIG. 1 and operated for continuously printing four sheets, 80 g/m$^2$ in basis weight, to produce an image of characters in the secondary color (blue), a wholly black image, an image of characters in the secondary color (blue), and a wholly white image. The wholly black image on the second sheet and the wholly white image on the fourth sheet were used for rating incomplete cleaning. The cleaning property was rated by the following method.

(Method for rating cleaning property)

The AC voltage to be applied to the ICL roller 12 is required to be a peak-to-peak voltage enough to start generation of a reversed discharge from the intermediate transfer member 7 to the ICL roller 12, preferred to possess a peak-to-peak voltage not less than twice as high as the voltage for starting discharge of the intermediate transfer member 7 and the ICL roller 12 (the voltage essentially conforming to the Paschen law), and needed to be at a still higher level where the toner is required to generate flight.

Figure 9:
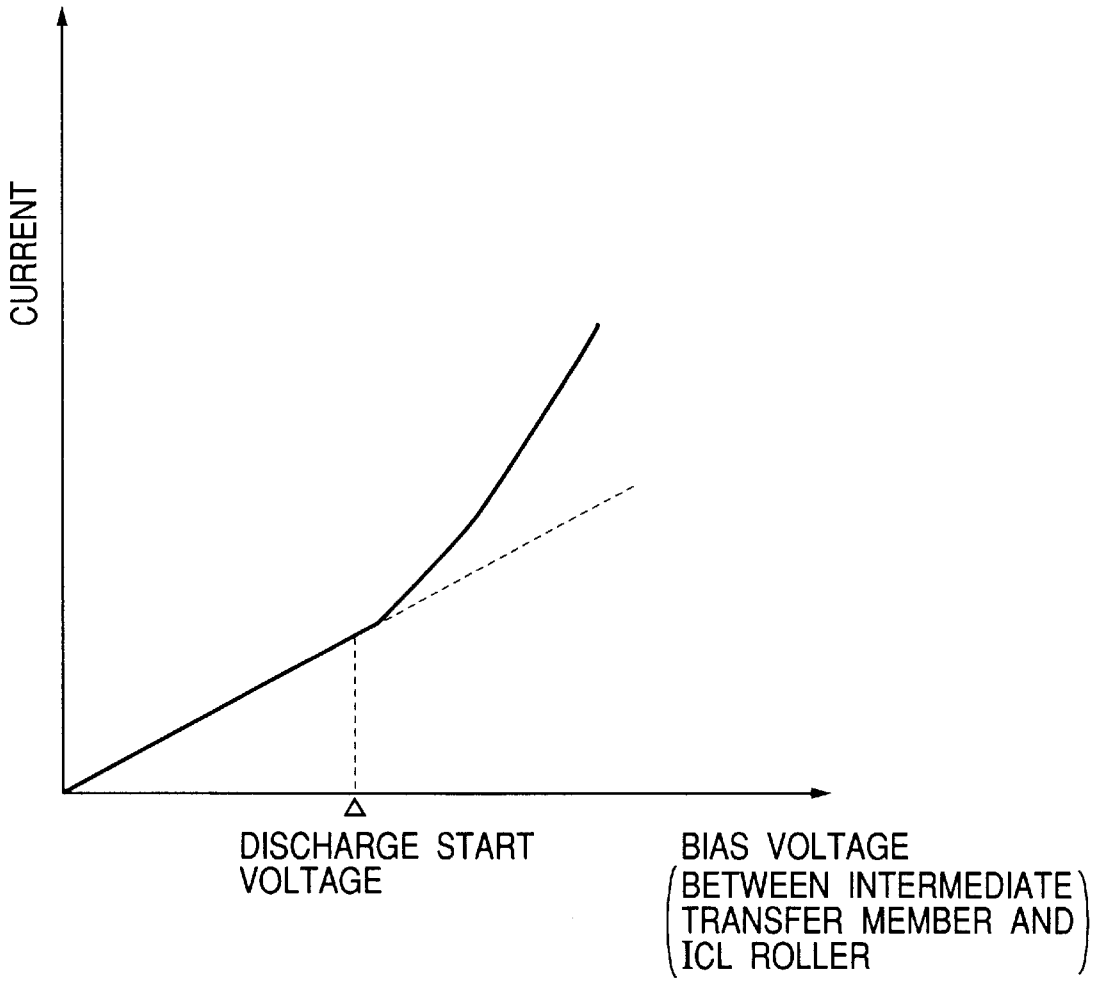
FIG. 9 is a diagram showing the current-voltage characteristics between the intermediate transfer member and the ICL roller.

While it is difficult to define the voltage for starting discharge between the intermediate transfer member 7 and the ICL roller 12, a DC voltage was applied between the two components to measure the current flowing therebetween and obtain a graph indicating the current-voltage characteristic as illustrated in FIG. 9. The voltage at which the trend of the current-voltage characteristics begins to change suddenly in the graph was taken as the voltage for starting the discharge essentially conforming to the Paschen law and a peak-to-peak voltage three times as high as the voltage for starting the discharge was used for the application. The frequency of the AC voltage was decided by the process speed of the image forming apparatus and the pitch (process speed/frequency) which was preferred to be not more than 1 mm was set at 100 $\mu$m in the present experiment. The AC voltage was formed in a rectangular wave which, unlike the sine wave, is capable of retaining a long time axis of peaks and consequently producing efficient electrification and flight of the secondary transfer residual toner at a low peak-to-peak voltage.

In the present example, the cleaning property was rated with the peak-to-peak voltage for application to the ICL roller 12 set at about 1800 V because the voltage for starting discharge between the intermediate transfer member 7 and the ICL roller 12 was about 600 V and the frequency at 1000 Hz because the process speed was 100 mm/sec. A continuous printing test for producing a full-color image on 5000 sheets was performed to rate the cleaning property in the continuous printing. Table 1 given below shows the results of the evaluations mentioned above.

Table 1

| | Intermediate transfer member Surface roughness | ICL roller Surface roughness | Sum of Rz (μm) | Results of rating: Cleaning property | Continuous printing and cleaning property | Remarks |
|---|---|---|---|---|---|---|
| Example 1 | 13 | 10 | 23 | ○ | ○ | Nothing particular to be noted. |
| Example 2 | 33 | 10 | 43 | ○ | ○ | Slight filming found on surface of intermediate transfer member after continuous printing. |
| Example 3 | 13 | 24 | 37 | ○ | ○ | Nothing particular to be noted. |
| Example 4 | 17 | 10 | 27 | ○ | ○ | Slight misregister of color found on image after continuous printing. |
| Comparative Example 1 | 13 | 10 | 23 | x | — | Test for cleaning property of continuous printing omitted because of poor cleaning property noted at the outset. |
| Comparative Example 2 | 44 | 10 | 54 | x | — | Test for cleaning property of continuous printing omitted because of poor cleaning property noted at the outset. |
| Comparative Example 3 | 0.4 | 0.4 | 0.8 | x | — | Test for cleaning property of continuous printing omitted because of poor cleaning property noted at the outset. |

It is clear from the results that the cleaning property and the cleaning property in continuous printing were both fully satisfactory. As respects the data in this table, the DC voltage applied to the ICL roller 12 was changed with intervals of 200 V in the range of 0 to 3000 V and the magnitudes of changed DC voltages were superimposed on the AC voltage under the conditions mentioned above. The case showing the presence of a combination reconciling negative ghost and cleaning is indicated with a mark of "o" and the case not showing the presence of such a combination is indicated with a mark of "x".

The conditions adopted for the image formation in the image forming apparatus illustrated in FIG. 1 were as follows.

Photosensitive member 1: OPC sensitive drum (negative polarity)

Surface potential:

Dark potential (potential in non-image part) =−580 V

Bright potential (potential in image part) =−200 V

Developer: Magnetic component toner (black) (normal polarity: negative) and nonmagnetic component toners (yellow, magenta, and cyan) (normal polarity: negative)

Primary transfer voltage: 100 V

Secondary transfer current: 15 μA

Process speed: 100 mm/sec

Developing bias:

DC voltage=−400 V

AC voltage=1600 V, peak-to-peak voltage

Frequency: 1800 Hz

Pressure of contact between intermediate transfer member 7 and photosensitive member 1: 2 kgf Pressure of contact between intermediate transfer member 7 and transfer belt 8: 5 kgf Pressure of contact between intermediate transfer member 7 and ICL roller 12: 1 kgf (EXAMPLE 2)

The manufacture of the ICL roller was similar in Example 1.

Manufacture of intermediate transfer member

An intermediate transfer member provided with a coating layer, about 30 μm in thickness, was obtained by preparing a paint for the formation of the coating layer similarly in Example 1, applying this paint by spray coating to a roller provided with an elastic layer obtained by the rubber composition shown in Example 1, drying the applied layer of the paint at 60° C. for 30 minutes, and drying to hardness the layer at 120° C. for two hours.

The real registance, surface registance, and surface roughness, Rz, of the produced intermediate transfer member were respectively $3\times10^{7}\Omega$, $1\times10^{13}\Omega/\square$, and 33 μm as shown in Table 1 mentioned above. These properties were determined similarly in Example 1.

Then, the ICL roller similar to that of Example 1 and the produced intermediate transfer member were installed in the image forming apparatus illustrated in FIG. 1 and operated to rate the cleaning property similarly in Example 1. In the present example, the cleaning property was rated with the peak-to-peak voltage for application to the ICL roller set at about 1800 V because the voltage for starting discharge between the intermediate transfer member and the ICL roller was about 600 V and the frequency at 1000 Hz because the process speed was 100 mm/sec. A continuous printing test for producing a full-color image on 5000 sheets was performed to rate the cleaning property in the continuous printing. Table 1 given below shows the results of the evaluations mentioned above.

It is clear from the results of the rating that the cleaning property and the cleaning property of continuous printing were both fully satisfactory. In the present example, though slight discernible filming was observed on the surface of the intermediate transfer member after the continuous printing, the filming brought about virtually no problem from the practical point of view.

(EXAMPLE 3)

The intermediate transfer member was manufactured similarly in Example 1.

Manufacture of ICL roller

An ICL roller provided with a coating layer, about 50 μm in thickness, was obtained by preparing a paint for the formation of the coating layer similarly in Example 1, applying this paint by spray coating to a roller provided with an elastic layer obtained by the rubber composition shown in Example 1, drying the applied layer of the paint at 50° C. for 30 minutes, and drying to hardness the layer at 100° C. for one hour.

The real registance, surface registance, and surface roughness, Rz, of the produced intermediate transfer member were respectively $4\times10^{8}\Omega$, $7\times10^{12}\Omega/\square$, and 24 μm as shown in Table 1 mentioned above. These properties were determined similarly in Example 1.

Then, the intermediate transfer member similar to that of Example 1 and the produced ICL roller were installed in the image forming apparatus illustrated in FIG. 1 and operated to rate the cleaning property similarly in Example 1. In the present example, the cleaning property was rated with the peak-to-peak voltage for application to the ICL roller set at about 1800 V because the voltage for starting discharge between the intermediate transfer member and the ICL roller was about 600 V and the frequency at 1000 Hz because the process speed was 100 mm/sec. A continuous printing test for producing a full-color image on 5000 sheets was performed to rate the cleaning property in the continuous printing. The results of these evaluations are shown in Table 1 mentioned above.

It is clear from the results of the rating that the cleaning property and the cleaning property of continuous printing were both fully satisfactory.

(EXAMPLE 4)

The ICL roller was manufactured similarly in Example 1.

Manufacture of intermediate transfer member

A rubber belt, 1 mm in thickness, was obtained by extrusion molding a rubber composition shown in Example 1, vulcanizing the extruded sheet of the rubber composition, and grinding the sheet. Then, an intermediate transfer member 17 shaped like a belt as illustrated in FIG. 6 was obtained by setting the rubber belt on an aluminum cylinder, 148 mm in outside diameter, forming a coating layer, about 50 μm in thickness, by applying the same paint for the formation of a coating layer as used in Example 1, and extracting the belt from the aluminum cylinder.

The real registance, surface registance, and surface roughness, Rz, of the produced intermediate transfer member were respectively $4\times10^{6}\Omega$, $2\times10^{12}\Omega/\square$, and 17 μm as shown in Table 1 mentioned above. These properties were determined similarly in Example 1.

Then, the intermediate transfer member similar to that of Example 1 and the produced ICL roller were installed in the image forming apparatus illustrated in FIG. 1 and operated to rate the cleaning property similarly in Example 1. In the present example, the cleaning property was rated with the peak-to-peak voltage for application to the ICL roller set at about 1800 V because the voltage for starting discharge between the intermediate transfer member and the ICL roller was about 600 V and the frequency at 1000 Hz because the process speed was 100 mm/sec. A continuous printing test for producing a full-color image on 5000 sheets was performed to rate the cleaning property in the continuous printing. The results of these evaluations are shown in Table 1 mentioned above.

It is clear from the results of the rating that the cleaning property and the cleaning property of continuous printing were both fully satisfactory. In the present example, though slight discernible misregister of color was observed in the image after the continuous printing, the color misregister brought about virtually no problem from the practical point of view.

(Comparative Example 1)

The same ICL roller and intermediate transfer member as used in Example 1 were installed in the image forming apparatus illustrated in FIG. 1. In this comparative example, the cleaning property was rated by using the same conditions as in Example 1 while applying a DC voltage of positive polarity alone to the ICL roller. The results of the rating are shown in Table 1 mentioned above.

It is clear from the results of the rating that no condition for reconciling cleaning and negative ghost could be found in the case of sole application of the DC voltage to the ICL roller. The test for cleaning property in continuous printing was not carried out because the cleaning property was bad even from the start of the experiment.

(Comparative Example 2)

The ICL roller was manufactured similarly in Example 1 and the intermediate transfer member was manufactured by using the conditions of Example 2 while changing xylene in the paint composition for coating the intermediate transfer layer to toluene and ethanol to methanol respectively.

The real registance, surface registance, and surface roughness, Rz, of the produced intermediate transfer member were respectively $4\times10^{7}\Omega$, $2\times10^{13}\Omega/\square$, and 44 μm as shown in Table 1 mentioned above. These properties were determined similarly in Example 1.

Then, the same ICL roller as used in Example 1 and the produced intermediate transfer member were installed in the image forming apparatus illustrated in FIG. 1 and operated to rate the cleaning property similarly in Example 1. In the present comparative example, the cleaning property was rated with the peak-to-peak voltage for application to the ICL roller set at about 1800 V because the voltage for starting discharge between the intermediate transfer member and the ICL roller was about 600 V and the frequency at 1000 Hz because the process speed was 100 mm/sec. A continuous printing test for producing a full-color image on 5000 sheets was performed to rate the cleaning property in the continuous printing. The results of these evaluations are shown in Table 1 mentioned above.

It is clear from the results of the rating that no condition for reconciling cleaning and negative ghost could be found in the case of using a changed paint composition for the formation of a coating layer on the intermediate transfer member. The test for cleaning property in continuous printing was not carried out because the cleaning property was bad even from the start of the experiment.

(Comparative Example 3)

The ICL roller which was obtained by following the procedure of Example 1 while having the surface thereof ground was adopted herein. The real registance, surface registance, and surface roughness, Rz, of the produced ICL roller were respectively $5\times10^{7}\Omega$, $6\times10^{11}\Omega/\square$, and 0.4 $\mu$m as shown in Table 1 mentioned above. These properties were determined similarly in Example 1.

The intermediate transfer member which was obtained by following the procedure of Example 1 while having the surface thereof ground was adopted herein.

The real registance, surface registance, and surface roughness, Rz, of the produced intermediate transfer member were respectively $6\times10^{6}\Omega$, $8\times10^{11}\Omega/\square$, and 0.4 $\mu$m as shown in Table 1 mentioned above. These properties were determined similarly in Example 1.

Then, these ICL roller and intermediate transfer member were installed in the image forming apparatus illustrated in FIG. 1 and operated to rate the cleaning property similarly in Example 1. In the present comparative example, the cleaning property was rated with the peak-to-peak voltage for application to the ICL roller set at about 1800 V because the voltage for starting discharge between the intermediate transfer member and the ICL roller was about 600 V and the frequency at 1000 Hz because the process speed was 100 mm/sec. The results of the evaluation are shown in Table 1 mentioned above.

It is clear from the results of the rating that no condition for reconciling cleaning and negative ghost could be found in the case of having the surfaces of both ICL roller and intermediate transfer member. The test for cleaning property in continuous printing was not carried out because the cleaning property was bad even from the start of the experiment.

According to this invention, the intermediate transfer member could be cleaned repeatedly and fully satisfactorily and the formation of fully satisfactory images could be continued for a long time because the sum of the surface roughness, Rz, of the intermediate transfer member and that of the charging member is set at a level of not less than 1 $\mu$m and not more than 50 $\mu$m as described above.

Further, this invention allows the throughput of the image formation to be improved by effecting the transfer of the transfer residual toner from the intermediate transfer member to the image bearing member as the same time that the primary transfer of the toner image from the image bearing member to the intermediate member is carried out.

What is claimed is:

1. An image forming apparatus, comprising:

an image bearing member for bearing a toner image, an intermediate transfer member for allowing the toner image on said image bearing member to undergo electrostatic primary transfer thereto at the position of primary transfer and then enabling the toner image deposited thereon to undergo secondary transfer to a transfer material, and a charging member for charging a residual toner remaining on said intermediate transfer member after said second transfer of the toner image on said intermediate transfer member to a transfer material and consequently causing said residual toner charged by said charging member to be transferred at said position of primary transfer to said image bearing member, wherein the sum of the surface roughness, Rz, of said intermediate transfer member and that of said charging member is not less than 1 $\mu$m and not more than 50 $\mu$m.

2. An apparatus according to claim 1, wherein the surface roughness of said intermediate transfer member is not more than 30 $\mu$m.

3. An apparatus according to claim 1, wherein said charging member is made to charge said residual toner on said intermediate transfer member by having applied thereto such a voltage as has an AC voltage superimpose a DC voltage of the reversed polarity relative to the polarity of the normal toner on said image bearing member.

4. An apparatus according to claim 3, wherein a next toner image on said image bearing member is made to undergo primary transfer onto said intermediate transfer member at the same time that said residual toner is transferred to said image bearing member at said position of primary transfer.

5. An apparatus according to claim 1, wherein said charging member is capable of making and breaking contact with said intermediate transfer member and said charging member is made to contact said intermediate transfer member prior to charging said residual toner.

6. An apparatus according to claim 1, wherein said charging member is a rotatable roller.

7. An apparatus according to claim 1, further comprising a primary transfer device for electrostatically effecting primary transfer of the toner image on said image bearing member at the position of primary transfer to said intermediate transfer member, said primary transfer device adapted to transfer said residual toner on said intermediate transfer member at said position of primary transfer to said image bearing member.

8. An apparatus according to claim 1, further comprising a cleaning device for recovering the toner on said image bearing member subsequently to said primary transfer, and said cleaning device recovers said residual toner transferred from said intermediate transfer member to said image bearing member.

9. An apparatus according to claim 1, wherein said image bearing member is capable of bearing an image formed of toners of a plurality of component colors, the toner images of said plurality of component colors undergo primary transfer as sequentially superimposed on said intermediate transfer member at said position of primary transfer, and the toner images undergone said first transfer as sequentially superposed on said intermediate transfer member are subjected to secondary transfer onto a transfer material at said position of secondary transfer.

* * * * *

UNITED STATES PATENT AND TRADEMARK OFFICE

CERTIFICATE OF CORRECTION

PATENT NO. : 5,950,058

DATED : September 7, 1999

INVENTOR(S) : TAKASHI KUSABA, et al.

It is certified that error appears in the above-identified patent and that said Letters Patent is hereby corrected as shown below:

COVER PAGE:

Under Attorney, Agent, or Firm, "Fitpatrick" should read --Fitzpatrick--.

ABSTRACT:

Line 2, "prises" should read --prising--.
Line 13, "member." should read --member,--.
Line 14, "Wherein" should read --wherein--.

COLUMN 1:

Line 66, "an" should read --a--.

COLUMN 2:

Line 14, "readily" should read --ready--.
Line 30, "an" should read --a--.

UNITED STATES PATENT AND TRADEMARK OFFICE

CERTIFICATE OF CORRECTION

PATENT NO. : 5,950,058

DATED : September 7, 1999

INVENTOR(S) : TAKASHI KUSABA, et al.

It is certified that error appears in the above-identified patent and that said Letters Patent is hereby corrected as shown below:

COLUMN 4:

Line 34, "an" should read --a--.
Line 59, "an" should read --a--.

COLUMN 7:

Line 35, "registance" should read --resistance--.

COLUMN 10:

Line 31, "registance" should read --resistance--.
Line 40, "registance" should read --resistance--.
Line 42, "registance)," should read --resistance),--.
Line 44, "registance" should read --resistance--.
Line 46, "registance" should read --resistance--.
Line 49, "registance" should read --resistance--.
Line 50, "registance" should read --resistance--.
Line 52, "registance" should read --resistance--.
Line 54, "registance" should read --resistance--.
Line 55, "registance" should read --resistance--.

UNITED STATES PATENT AND TRADEMARK OFFICE

CERTIFICATE OF CORRECTION

PATENT NO. : 5,950,058

DATED : September 7, 1999

INVENTOR(S) : TAKASHI KUSABA, et al.

It is certified that error appears in the above-identified patent and that said Letters Patent is hereby corrected as shown below:

COLUMN 10:

Line 57, "registance" should read --resistance--.
Line 59, "registance" should read --resistance--.

COLUMN 11:

Line 5, "registance" (both occurrences) should read --resistance--.

COLUMN 12:

Line 56, "registance" should read --resistance--.
Line 57, "registance" should read --resistance--.
Line 61, "registance" should read --resistance--.

COLUMN 13:

Line 1, "registance" should read --resistance--.
Line 8, "registance" should read --resistance--.

UNITED STATES PATENT AND TRADEMARK OFFICE

CERTIFICATE OF CORRECTION

PATENT NO. : 5,950,058

DATED : September 7, 1999

INVENTOR(S) : TAKASHI KUSABA, et al.

It is certified that error appears in the above-identified patent and that said Letters Patent is hereby corrected as shown below:

COLUMN 13:

Line 9, "registance" should read --resistance--.
Line 15, "registance" should read --resistance--.
Line 17, "registance" should read --resistance--.
Line 53, "registance" should read --resistance--.
Line 54, "registance" should read --resistance--.
Line 58, "registance" should read --resistance--.
Line 66, "registance" should read --resistance--.

COLUMN 14:

Line 16, "registance" should read --resistance--.
Line 18, "registance" should read --resistance--.

COLUMN 16:

Line 46, "registance," (both occurrences) should read --resistance,--.

UNITED STATES PATENT AND TRADEMARK OFFICE

CERTIFICATE OF CORRECTION

PATENT NO. : 5,950,058

DATED : September 7, 1999

INVENTOR(S) : TAKASHI KUSABA, et al.

It is certified that error appears in the above-identified patent and that said Letters Patent is hereby corrected as shown below:

COLUMN 17:

Line 20, "registance," (both occurrences) should read --resistance,--.
Line 56, "registance," (both occurrences) should read --resistance,--.

COLUMN 18:

Line 38, "registance," (both occurrences) should read --resistance,--.

COLUMN 19:

Line 1, "registance" should read --resistance--.
Line 2, "registance" should read --resistance--.
Line 9, "registance" should read --resistance--.

Signed and Sealed this

Eleventh Day of July, 2000

*Attest:*

Q. TODD DICKINSON

*Attesting Officer*

*Director of Patents and Trademarks*